United States Patent [19]

Clem et al.

[11] Patent Number: 4,846,894

[45] Date of Patent: Jul. 11, 1989

[54] AIR RECUPERATOR CLEANER

[75] Inventors: Jack L. Clem; Oscar T. Scott, IV, both of Borger, Tex.

[73] Assignee: J. M. Huber Corporation, Borger, Tex.

[21] Appl. No.: 811,418

[22] Filed: Dec. 20, 1985

Related U.S. Application Data

[62] Division of Ser. No. 613,110, May 23, 1984, Pat. No. 4,577,680.

[51] Int. Cl.[4] ..... F28G 13/00; B08B 5/00

[52] U.S. Cl. ..... 134/1; 15/316 R; 15/317; 15/316 A; 134/6; 134/7; 134/31; 165/95; 165/96

[58] Field of Search ..... 165/95, 96, 98, 99, 165/101, 174, 1, 103; 134/22.11, 22.12, 22.18, 17, 25.5, 31; 122/390; 15/316 R, 317, 18, 319, 406, 316 A; 55/97

[56] References Cited

U.S. PATENT DOCUMENTS

| | | | |
|---|---|---|---|
| 2,069,574 | 2/1937 | Bowers | 122/390 |
| 3,139,711 | 7/1964 | Soderberg, Jr. | 134/8 |
| 3,364,983 | 1/1968 | Krinov et al. | 165/1 |
| 4,141,753 | 2/1979 | Creed | 134/24 |
| 4,141,754 | 2/1979 | Frauenfeld | 134/24 |
| 4,366,003 | 12/1982 | Konte et al. | 134/18 |
| 4,577,680 | 3/1986 | Clem et al. | 165/95 |
| 4,617,988 | 10/1986 | Kohnen et al. | 165/95 |

*Primary Examiner*—Asok Pal

*Attorney, Agent, or Firm*—Wall and Roehrig

[57] ABSTRACT

A method and apparatus for interrupting the flow of carbon black particle-carrying transport as passing through recuperator tubes for a short period of time to cause the carbon black material accumulating and adhering to the inner walls of the tube to be removed therefrom and swept from the tube by the resumption of transporter gas flow.

3 Claims, 2 Drawing Sheets

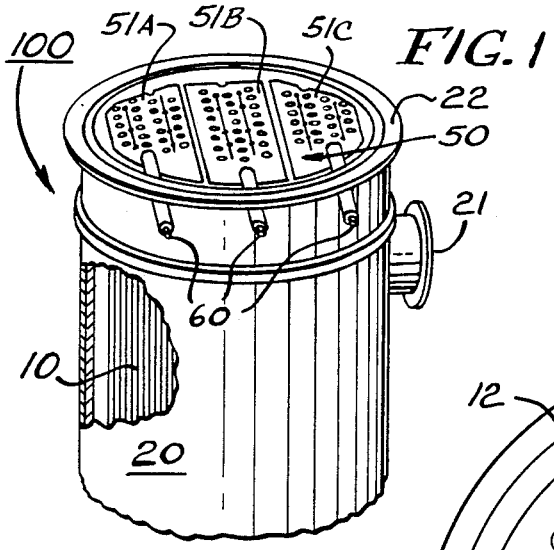
FIG. 1
FIG. 2
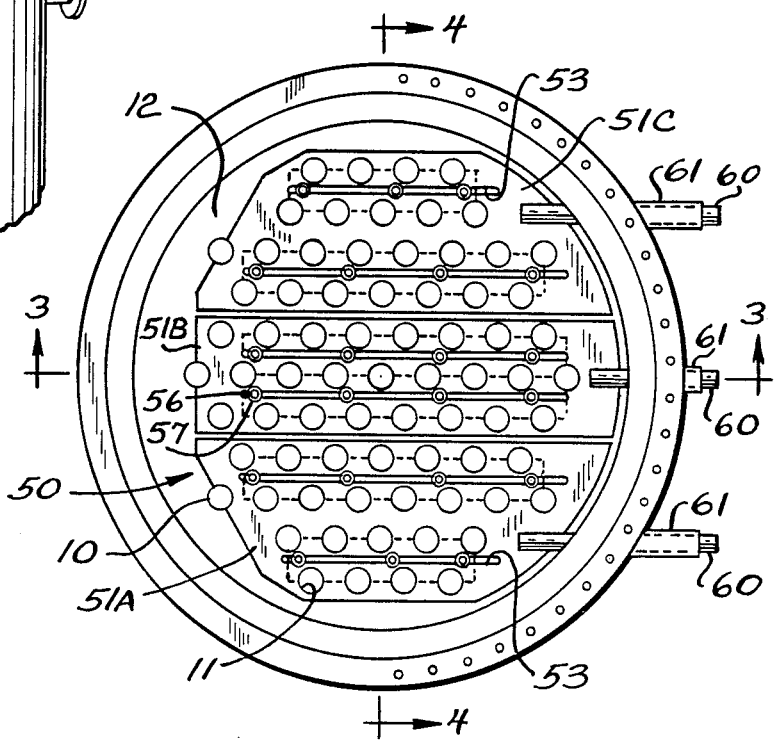
FIG. 3
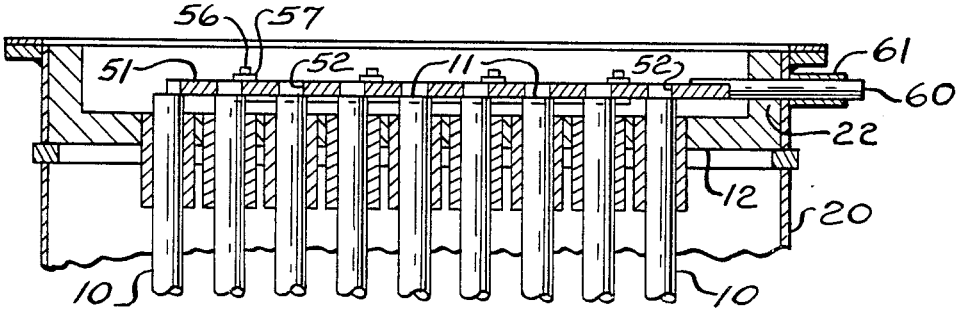
FIG. 4
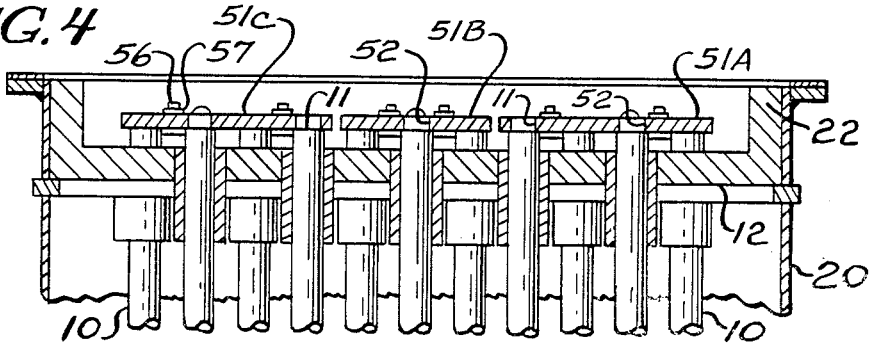

FIG. 5
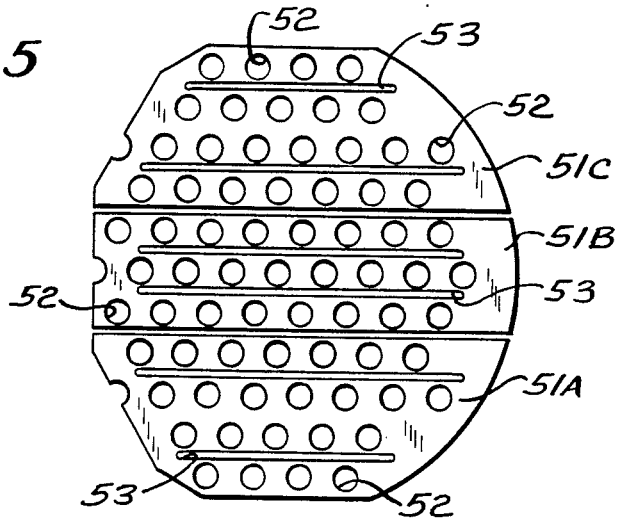
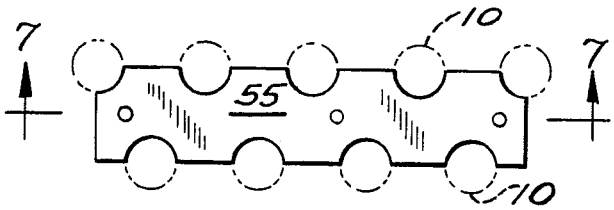
FIG. 6
FIG. 7
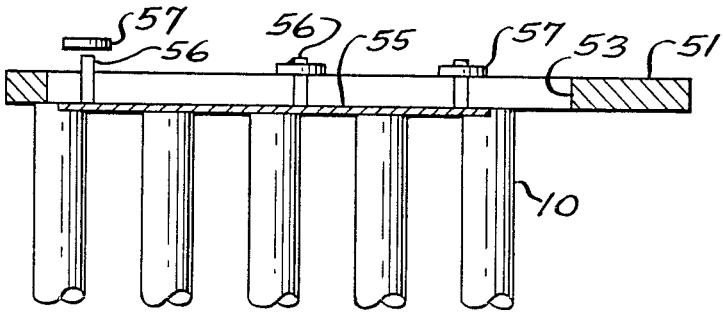
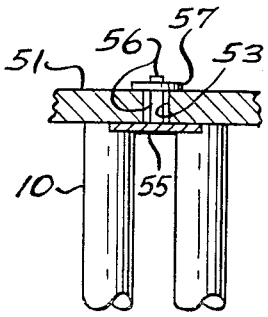
FIG. 8

AIR RECUPERATOR CLEANER

This application is a division of Application Ser. No. 613,110, filed May 23, 1984, now U.S. Pat. No. 4,577,680.

BACKGROUND OF THE INVENTION

This invention relates in general to a method and apparatus for cleaning air recuperators and, in particular, to an on-line method and apparatus for air-recuperator cleaning.

More specifically, but without restriction to the particular use which is shown and described, this invention relates to a method and apparatus for on-line cleaning of finely-divided carbon black powder deposits from gas-to-gas tube and shell recuperators.

In the production of carbon black or other highly dispersed, high-surface activity solids formed by pyrogenic processes, the solids are transported by a gas stream for ultimate deposition in flexible tube filters or similar devices. Before depositing the solids materal on or in such filters, it is desirable to remove the heat from the transporting gas for reuse in the system. Therefore, the heat from such transport gas is generally removed by heat exchangers which include bundles of tubes through which the transport gas and carbon black solids material is passing. As the carbon black is carried through the tubes by the transport gas, deposits of carbon black particles form on the internal walls of the tubes. These deposits reduce both the flow of the transport gas through the tubes, and the efficient transfer of heat from the gas. In particularly aggravated solutions, a complete blockage of an individual tube can occur which may lead to damage of the heat exchanger. Since the ends of the tube are secured in a tube sheet, a tube in which the carbon build-up has caused a blockage becomes cooler than the adjacent tubes through which the hot transport gas is being passed. As a result, the cooler tube produces contraction stresses on the tube sheet which can tear the blocked tube free from its mounting in the tube sheet.

In an attempt to resolve this problem, some heat exchangers are designed such that the decrease in heat transfer efficiency is attempted to be compensated for by increasing the heat exchange surface area thereby oversizing the apparatus for the needs of the process. However, such oversizing is a temporary solution to the problem. As the unit is in service, deposits and subsequent fouling will eventually occur, decreasing the system efficiency and resulting in a decrease below process requirements.

Various methods and apparatus have been utilized to clean carbon black deposits from the tube interiors such as chemical treatment with or without mechanical scrubbing. However, chemical methods require that the unit be taken off-line and out of production, as well as requiring expert handling of the chemicals to prevent damage to the metal parts of the heat exchanger. The various mechanical cleaning methods which have been utilized require a large amount of manual labor, such as by forcing a long worm or wire brush through each tube, or sandblasting.

Accordingly, different attempts have been made to prevent such excessive build-up by utilizing cleaning jet nozzles such as disclosed in U.S. Pat. Nos. 2,069,574; 3,364,983; 4,141,754; and 4,366,003. Each of the systems disclosed in these patents utilizes a discharge of high pressure air from jet nozzles positioned over an inlet opening to the tube in order to provide a short burst of a cleaning gas into the processing tubes. While such systems may be somewhat satisfactory, they increase the mechanical complexity of the overall system, and necessitate added controls and maintenance costs.

SUMMARY OF THE INVENTION

It is, therefore, an object of this invention to improve the method and apparatus for cleaning air recuperators by removing built-up carbon deposits from the inner surfaces of a transporter tube through which the carbon black particles are transported when extracting heat from the transport gas.

Another object of this invention is to prevent excessive build-up or blockage of the transport tube due to the accumulation of finely-dispersed, high surface activity solids transported in the gas stream through the transport tubes.

A further object of this invention is to prevent excessive build-up of carbon black particles on the interior walls of a heat exchange transporter tube through an on-line system which does not require that the heat exchanger be taken off-line in order to prevent such excessive build-up.

Still another object of this invention is to clean finely-divided inorganic powder deposits from gas-to-gas tube and shell recuperators without interrupting the operation of the heat exchanger or utilizing chemical cleaning processes or expensive, maintenance-requiring mechanical cleaning systems.

These and other objects are attained in accordance with the present invention wherein there is provided a method and apparatus for interrupting the flow of carbon black particle-carrying transport gas passing through recuperator tubes for a short period of time to cause the carbon black material accumulating and adhering to the inner walls of the tube to be removed therefrom and swept from the tube by the resumption of transporter gas flow.

DESCRIPTION OF THE DRAWINGS

Further objects of the invention together with additional features contributing thereto and advantages accuring therefrom will be apparent from the following description of a preferred embodiment of the invention which is shown in the accompanying drawings with like reference numerals indicating corresponding parts throughout, wherein:

FIG. 1 is a frontal perspective view of a gas-to-gas shell and tube recuperator apparatus utilizing the invention;

FIG. 2 is a horizontal planar view of the top of a recuperator apparatus such as illustrated in FIG. 1 with portions broken away to illustrate components of the invention;

FIG. 3 is a partial sectional view of the apparatus shown in FIG. 2 taken along lines 3—3;

FIG. 4 is a partial sectional view of the apparatus shown in FIG. 2 taken along lines 4—4;

FIG. 5 is a horizontal planar view of a portion of the apparatus of the invention;

FIG. 6 is a horizontal planar view of a portion of the invention to better illustrate the components thereof;

FIG. 7 is a cross-sectional view of the structure shown in FIG. 6 taken along lines 7—7; and FIG. 8 is an enlarged illustration of a portion of the invention to better illustrate the details thereof.

DESCRIPTION OF A PREFERRED EMBODIMENT

Referring now to FIG. 1, there is illustrated a gas-to-gas shell and tube recuperator 100 having a plurality of individual recuperator tubes 10 secured in a tube sheet 12 and through which a carbon black particle carrying transport gas is passed. The tubes 10 are enclosed by a shell 20 into which a heat exchanging medium or transfer gas is introduced through an inlet 21 to remove and transfer the heat from the transport gas for further use. The heat transfer gas passes within the shell 20 and out through a distance outlet, not shown, to remove heat from the transfer gas passing through the tubes 10.

As previously discussed, during the transport of the carbon black particles through the tubes 10, the interior surface of the tubes accumulates carbon black particles. This accumulation interferes with the efficient transfer of heat from the transport gas to the heat transfer medium being circulated through the recuperator shell 20, and may eventually clog the tube interior which can result in a tube 10 pulling loose from the tube sheet 12 in which it is secured. Therefore, a shutter or flow interrupter assembly 50 is positioned adjacent to a discharge end 11 of the tubes 10, to provide a system for removing the carbon black build-up within the tube interior.

The shutter assembly 50 includes a shutter or slide plate 51 formed in three sections 51A, 51B, and 51C, all three of which function in the same manner and, except for the differences in shape, are structurally the same. Therefore, for convenience of illustration, these shutter plates will be referred to by the general reference numeral 51.

As shown in FIG. 2, the shutter plates 51 are supported adjacent the discharge end 11 of the recuperator tubes 10 and are formed with a series of holes or apertures 52 corresponding in number and size to the adjacent discharge opening 11 of the tubes 10. In this manner the carbon black particle-carrying transport gas will pass through the holes 52 formed in the shutter plate 51 for further processing. The shutter or slide plate 51, shown in planar view in FIG. 5, also has a plurality of guide slots 53 formed longitudinally in the shutter plate 51 between adjacent rows of apertures 52 to assist in guiding the sliding movement of the shutter plate.

Each of the shutter or slide plates 51 is secured at one end to a push rod 60 which is appropriately journaled 61 in a flange portion 22 of the recuperator shell 20 to permit sliding movement of the shutter plate 51 in a direction transverse to the longitudinal axis of the recuperator tubes 10. The length of travel of the push rod 60 and the length of the guide slots 53 can function to limit the sliding plate movement. The push rod 60 may be spring-loaded to return to an initial, unbiased portion wherein the apertures 52 formed in the slide or shutter plate 51 are coaxially aligned with the discharge opening 11 of the recuperator tubes 10 and out of intereference with the flow of carbon black particle-carrying transport gas. In addition, the pins 60 may be connected to a suitble apparatus, not shown, which will impart a quick sliding movement to the shutter plates 51 to move the plate into and out from interference with the flow of the transport gas through the recuperator tubes 10 as desired.

As best shown in FIGS. 3–8, the shutter plate 51 is supported adjacent to, or in sliding contact with, the discharge end 11 of the recuperator tubes 10 such that the plate may slide into a position to block the discharge end 11 of the recuperator tubes 10. Support plates 55 are cut to conform to the outer peripheral surface of the recuperator tubes 10, and are welded near the discharge end 11 thereof out of interference with the flow of the transport gas therethrough. A plurality of vertically extending guide pins 56 are welded to the face of the support plates 55. The guide pins 56 extend outwardly a distance sufficient to pass through the guide slots 53 of the shutter plate 51. Upon positioning of the shutter plate with the guide pins 56 extending through the guide slots formed therein, a corresponding plurality of washers 57 are tack-welded to the protruding end of the guide pins 56 to hold the slide or shutter plates 51 in proper alignment when moved transversely into and out from blocking the flow of the transport gas through the recuperator tubes 10. In this manner, the transverse sliding movement of the shutter plates 51 into and out from blocking the discharge from the recuperator tubes 10 will be guided and controlled.

The movement of the slide or shutter plates 51 across the discharge ends 11 of the recuperator tubes 10 is preferably done very quickly, and suddenly, for a short time period such as on the order of one-second duration. The more sudden and complete the blockage of the discharge end 11 of the tubes, the more beneficial the effect in dislodging the carbon particle build-up from the tube interior. The frequency of blocking the transport gas flow in order to maintain acceptable recuperator performance varies with the type of finely-divided powder being produced, but is believed to generally range from one to sixty cycles per hour. While it is not known with certainty as to what causes this dislodgement, it is believed that the coating dislodgement occurs through three basic mechanisms;

1. A water hammer effect and concomitant pressure wave which travels down the tube causing rapid compression and expansion of the transport gas in the recuperator tube, thus mechanically breaking or dislodging some of the carbon deposits from the tube interior.

2. The sudden blockage of the tube results in the recuperator tube cooling for a fraction of a second, such that the resultant differential expansion of the processing tube and the internal carbon black particle coating weakens the binding of the carbon black particles to the tube interior.

3. The sudden stoppage of the transport gas flow results in the cessation of an electric current being generated by movement of the finely-divided particles carried in the transport gas stream. This electrostatic charge which is generated by this movement is imparted to the individual carbon black particles causing them to adhere to the interior wall of the tubes. Interruption of the flow of the transport gas permits this electrostatic charge to be dissipated through the metal walls of the tubes at a rate faster than the charge is being accumulated, thus reducing or eliminating some of the electrostatic attractive forces which are believed to create, in part, the accumulation of the carbon black particles.

While the invention has been described in the specification and illustrated in the drawings with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A method of removing accumulated deposits of finely-divided solids particles adhering to the interior surface of a tube through which the particles are carried in a transport gas, comprising the steps of passing a finely-divided particle-bearing transport gas through a tube in which the particles adhere to the interior surface thereof, and periodically quickly blocking and then suddenly resuming the flow of the particle-bearing transport gas at a downstream discharge end of the tube thereby creating a pressure wave therein to loosen the solids particle accumulation upon interrupting the flow of transport gas from the discharge end of the tube and removing the loosened solids particle accumulation upon resuming the flow of transport gas through the tube.

2. A method of removing accumulated deposits of finely-divided solids particles adhering to the interior surface of a tube through which the particles are carried in a transport gas, comprising the steps of passing a finely-divided particle-bearing transport gas through a tube in which the particles adhere to the interior surface thereof, and periodically quickly blocking and then suddenly resuming the flow of the particle-bearing transport gas at a downstream discharge end of the tube thereby cooling the tube momentarily to loosen the solids particle accumulation upon interrupting the flow of transport gas from the discharge end of the tube and removing the loosened solids particle accumulation upon resuming the flow of transport gas through the tube.

3. A method of removing accumulated deposits of finely-divided solids particles adhering to the interior surface of a tube through which the particles are carried in a transport gas, comprising the steps of passing a finely-divided particle-bearing transport gas through a tube in which the particles adhere to the interior surface thereof, and periodically quickly blocking and then suddenly resuming the flow of the particle-bearing transport gas at a downstream discharge end of the tube thereby dissipating the electrostatic charge imparted on the particles to loosen the solids particle accumulation upon interrupting the flow of transport gas from the discharge end of the tube and removing the loosened solids particle accumulation upon resuming the flow of transport gas through the tube.

* * * * *